US007377006B2

(12) United States Patent
Genoa et al.

(10) Patent No.: US 7,377,006 B2
(45) Date of Patent: May 27, 2008

(54) VACUUM CLEANER WITH MAGNETIC PICK-UP MECHANISM

(75) Inventors: Mark Genoa, Melville, NY (US); Scott Genoa, Merrick, NY (US)

(73) Assignee: Imig Inc., Melville, NY (US)

( * ) Notice: Subject to any disclaimer, the term of this patent is extended or adjusted under 35 U.S.C. 154(b) by 524 days.

(21) Appl. No.: 10/977,637

(22) Filed: Oct. 29, 2004

(65) Prior Publication Data

US 2006/0090287 A1 May 4, 2006

(51) Int. Cl.
*A47L 5/00* (2006.01)

(52) U.S. Cl. ..... 15/325; 5/329

(58) Field of Classification Search ..... 15/325, 15/339

See application file for complete search history.

(56) References Cited

U.S. PATENT DOCUMENTS 2,288,115 A * 6/1942 Soldanels ..... 15/339
2,677,461 A * 5/1954 Bodey ..... 209/215
2,847,084 A * 8/1958 Wolfskill et al. ..... 96/416
4,279,745 A 7/1981 Haase
4,300,260 A 11/1981 Hill
4,598,439 A 7/1986 Good
4,759,095 A 7/1988 Hoy, Jr.
5,052,074 A * 10/1991 Korsen ..... 15/339
5,179,756 A * 1/1993 Korsen ..... 15/246
5,271,119 A 12/1993 Myers et al.
6,341,403 B1 1/2002 Strickrodt et al.
2005/0217063 A1* 10/2005 Paterson et al. ..... 15/325

FOREIGN PATENT DOCUMENTS

JP 02305533 A * 12/1990

* cited by examiner

*Primary Examiner*—David Redding
(74) *Attorney, Agent, or Firm*—Frishauf, Holtz, Goodman & Chick, P.C.

(57) ABSTRACT

Vacuum cleaner with a magnetic pick-up mechanism includes a housing having a front wall and a vacuum opening situated rearward of the front wall, one or more receptacles on the front wall, one or more magnets arranged in the receptacle(s) and a bumper attached to the housing and extending across the front wall and over the magnet(s). Each magnet attracts metallic objects during use of the vacuum cleaner so that the metallic objects do not enter into the vacuum opening and damage to the interior parts of the vacuum cleaner housing is prevented.

22 Claims, 4 Drawing Sheets

VACUUM CLEANER WITH MAGNETIC PICK-UP MECHANISM

FIELD OF THE INVENTION

The present invention relates to a vacuum cleaner including a magnetic pick-up mechanism capable of picking up metallic objects in floor coverings, such as rugs and carpets, to prevent such metallic objects from entering the vacuum cleaner housing.

BACKGROUND OF THE INVENTION

In the vacuum cleaner art, it is known that it is desirable to prevent entry of metallic objects, such as paper clips, pins and staples, into the vacuum cleaner housing to prevent damage to interior parts of the housing such as the motor. Various attachments for vacuum cleaners have been developed which position one or more magnets on the vacuum cleaner housing to attract metallic objects before they can enter into the housing and/or into a suction intake passage defined in the housing.

U.S. Pat. No. 4,279,745 (Haase) describes an attachment for a vacuum cleaner comprising a flexible housing having a series of pockets, each pocket containing a magnet. The attachment housing is attached to a front wall of the vacuum cleaner housing by adhesive tape or screws.

U.S. Pat. No. 4,300,260 (Hill) describes an elongated strip of flexible magnetizable material that is attached to the front face of a vacuum cleaner housing by either screws, adhesive tape or VELCRO® and is positioned lower than the front face of the vacuum cleaner housing.

U.S. Pat. No. 4,598,439 (Good) describes a magnetic attachment device mounted under the housing and rearwardly of the suction passage. The attachment is secured to a side wall of the housing by a clamp and is laterally adjustable.

U.S. Pat. No. 4,759,095 (Hoy, Jr.) describes a magnetic pick-up device including a plastic housing and magnetic strips mounted in the housing. The magnetic pick-up device is mounted on the front of a vacuum cleaner housing.

U.S. Pat. No. 5,179,756 (Korsen) describes a coated magnetic pick-up bar attached to a vacuum cleaner housing with hook and loop fastener material, i.e., VELCRO®.

U.S. Pat. No. 5,271,119 (Myers) describes a combination protective shield and metal capture apparatus for covering a vacuum cleaner housing. The apparatus includes a pouch fixed to a bonnet which covers the top of the vacuum cleaner housing and a magnet arranged in the pouch. The pouch is situated in front of the vacuum cleaner housing and thereby picks up metallic objects before the vacuum cleaner housing passes over them.

U.S. Pat. No. 6,341,403 (Strickrodt et al.) describes a protecting guard for a vacuum cleaner bumper that picks up magnetic metal objects in rugs or carpets prior to such objects entering the vacuum cleaner housing. The guard covers the front and sides of the vacuum cleaner housing, while leaving the top of the housing open or easily accessible. The guard is made of a durable outer covering and contains, disposed within the outer covering, a magnet and padding. The bumper is secured to the vacuum cleaner by a strap that can be removably fastened to the bumper, or alternatively the bumper is directly affixed to the vacuum cleaner housing with adhesive.

One concern with some if not all of the above-described magnetic pick-up devices is their durability especially when used on commercial vacuum cleaners. Also, if the magnetic pick-up devices are situated on the exterior of the vacuum cleaner housing, they are liable to constantly impact objects causing damage thereto or causing the magnets to be dislodged and lost.

SUMMARY OF THE INVENTION

Accordingly, it is an object of the present invention to provide a new and improved vacuum cleaner including a magnetic pick-up mechanism capable of picking up metallic objects in rugs or carpets prior to entering the vacuum cleaner housing to thereby prevent such metallic objects from entering the vacuum cleaner housing and causing damage to interior parts of the vacuum cleaner, such as the motor.

It is another object of the present invention to provide a new and improved housing for a vacuum cleaner including a magnetic pick-up mechanism.

It is another object of the present invention to provide a new and improved magnetic pick-up mechanism for a vacuum cleaner which is durable and securely retains magnets in a position in which they are not easily damaged or dislodged.

It is yet another object of the present invention to provide a new and improved method for attracting metallic objects to a vacuum cleaner housing in floor coverings prior to passage of a vacuum opening in the housing over the metallic objects.

In order to achieve these objects and others, a vacuum cleaner with a magnetic pick-up mechanism in accordance with one embodiment of the invention includes a housing having a front wall and a vacuum opening situated rearward of the front wall, one or more receptacles formed on the front wall, one or more magnets arranged in the receptacle(s) and a bumper attached to the housing and extending across the front wall and over the magnet(s). Each magnet attracts metallic objects during use of the vacuum cleaner so that the metallic objects do not enter into the vacuum opening and damage to the interior parts of the vacuum cleaner housing is prevented.

In one embodiment, each receptacle is formed on a forward side of the front wall so that each magnet is situated between the bumper and the front wall. To form such receptacle(s), the housing may include a lower support wall projecting outward and forward from a front surface of the front wall, a substantially vertical retaining wall extending upward from a forward edge region of the lower wall and retaining side walls each arranged at a lateral edge portion of the lower and vertical walls. One or more intermediate separation walls can be formed between the side walls to partition the space between the walls into a plurality of individual receptacles. These walls may be integrally formed with the front wall of the housing, and possibly other walls of the housing.

Another way to consider the invention is a vacuum cleaner with a housing having a front wall and a vacuum opening situated rearward thereof, a bumper attached to the housing and extending across the front wall and a magnetic pick-up mechanism arranged in connection with the front wall and between the front wall and the bumper. By positioning the bumper over the magnetic pick-up mechanism, magnets in the magnetic pick-up mechanism are not easily dislodged and lost. The pick-up mechanism may comprise one or more receptacles on the front wall, preferably formed on a forward side of the front wall, and one or more magnets arranged therein. The bumper is removable from attachment to the housing while the pick-up mechanism remains in connection with the front wall. As such, it is possible to replace damaged or lost magnets by removing the bumper to access the pick-up mechanism and then reattaching the bumper to the housing.

A method for attracting metallic objects in floor coverings to a vacuum cleaner housing prior to passage of a vacuum opening in the vacuum cleaner housing over the floor coverings is also disclosed and involves forming at least one receptacle on a front wall of the vacuum cleaner housing, arranging at least one magnet in the receptacle(s) and attaching a bumper to the housing to cover the magnet(s). The receptacle(s) may be formed by additional walls integral with the front wall of the vacuum cleaner housing and/or on a forward side of the vacuum cleaner housing.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE PREFERRED EMBODIMENT

Figure 1:
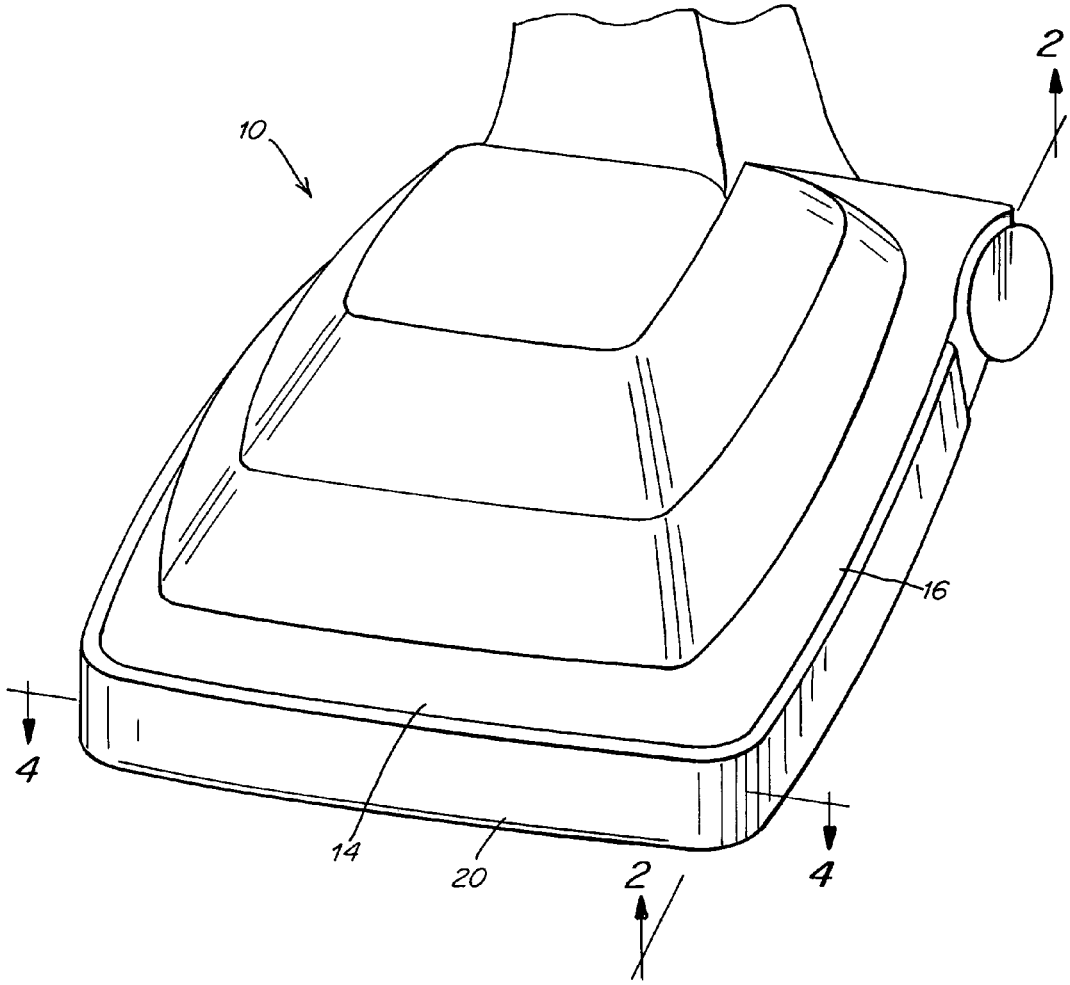
FIG. 1 is a perspective view of the bottom part of a vacuum cleaner housing with a magnetic pick-up mechanism in accordance with the invention.
Figure 2:
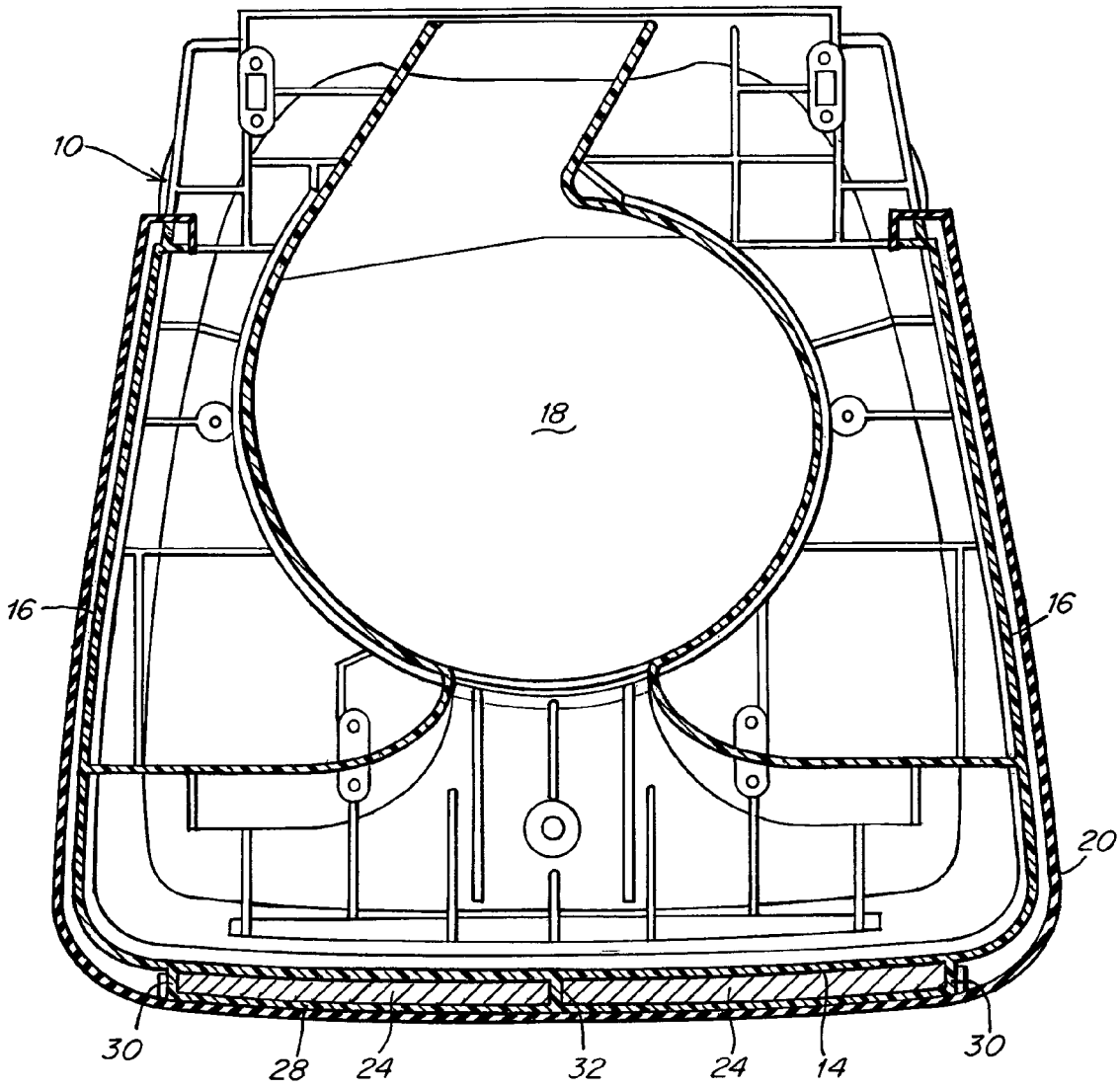
FIG. 2 is a cross-section taken along the line 2-2 in FIG.

Referring to the accompanying drawings, FIG. 1 shows a vacuum cleaner housing 10 with a magnetic pick-up mechanism 12 in accordance with the invention. Housing 10 generally includes a front wall 14, side walls 16, a suction intake or vacuum opening 18 through which debris and litter are drawn by a vacuum force and which is situated rearward of the front wall 14 and between the side walls 16, a bumper 20 and other structure typical of a vacuum cleaner housing, e.g., rollers with bristles, wheels and the like. Bumper 20 extends over the front wall 14 and part of the side walls 16 and is attached to the housing 14 in any conventional manner, e.g., by sliding its ends into slots on the side walls 16.

Figure 3:
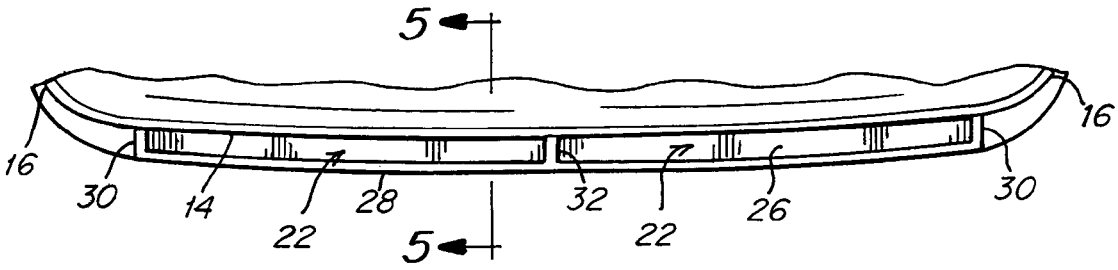
FIG. 3 is a partial top view of the vacuum cleaner housing shown in FIG. 1 shown with the bumper and magnets removed.

The magnetic pick-up mechanism 12 in accordance with the invention comprises a pair of magnet-receiving receptacles 22 and magnets 24 arranged in the receptacles 22. Receptacles 22 are preferably formed on a forward side of the front wall 14 as shown in FIG. 3. By positioning the magnets 24 in connection with the front wall 14, when the vacuum cleaner is pushed over a rug or carpeting in a forward direction, the magnets 24 pass over metallic objects in the rug or carpeting, e.g., paper clips, before the vacuum opening 18 and cause the objects to be drawn toward the magnets 24 and retained for example, on the bumper 20.

Receptacles 22 are formed by a lower support wall 26 which projects outward and forward from the front surface of the front wall 14, a substantially vertical retaining wall 28 extending upward from a forward edge region of the lower wall 26, retaining side walls 30 each arranged at a lateral edge portion of the lower and vertical walls 26, 28 and an intermediate separation wall 32 interposed between the side walls 30 to partition the space between the lower, vertical and side walls 26, 28, 30 into the two receptacles 22. As such, each receptacle 22 has only an open top, the remaining sides being closed, which enables insertion and removal of the magnets 24 therefrom.

Figure 7:
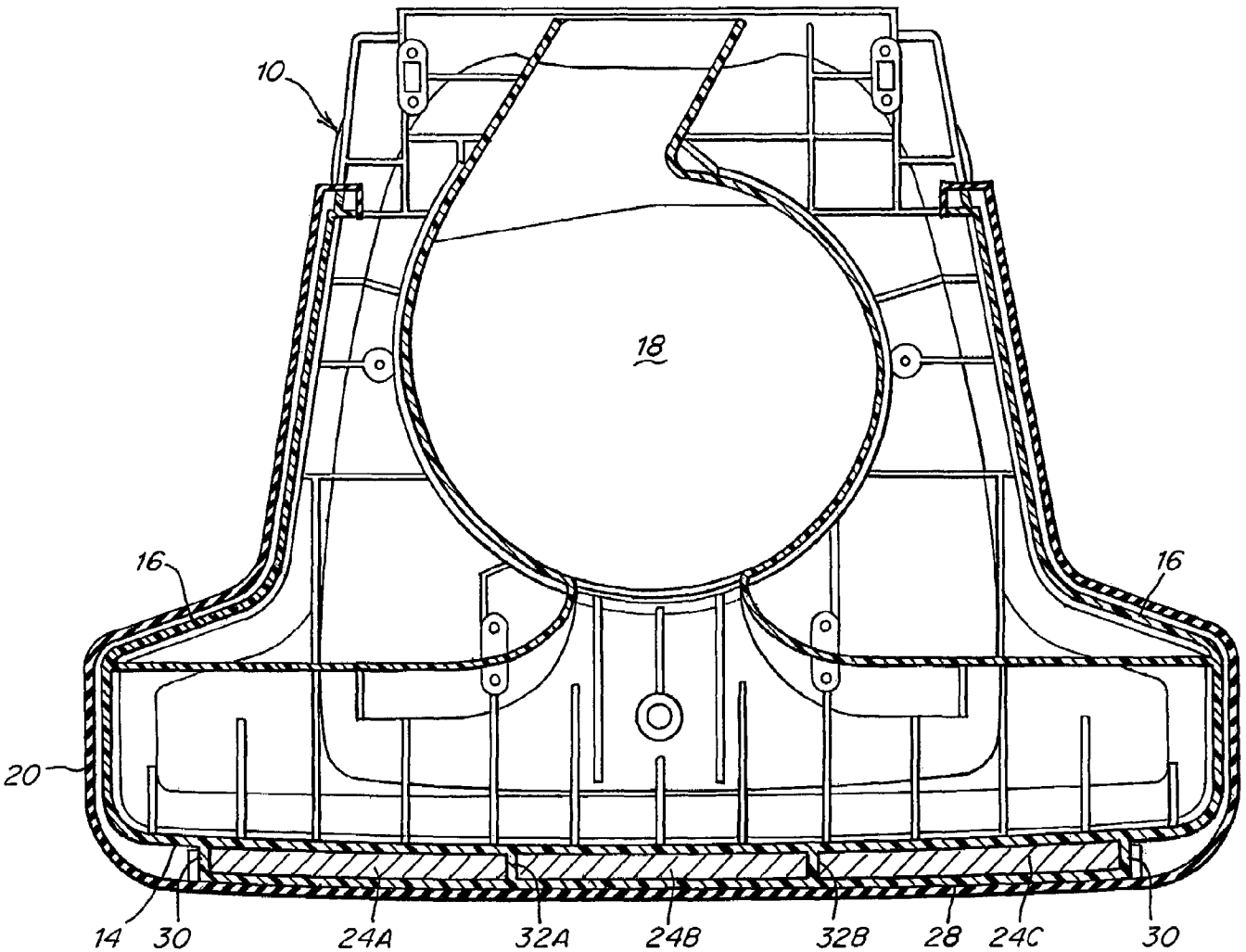
FIG. 7 is a cross-section similar to FIG. 2 but showing an alternate vacuum cleaner housing with a magnetic pick-up mechanism in accordance with the invention.

Any number of intermediate walls can be provided to partition the space between the lower, vertical and side walls 26, 28, 30 into individual receptacles. For example, as shown in FIG. 7, two intermediate walls 32A, 32B are provided to form three receptacles. In this case, three magnets 24A, 24B, 24C would be provided, one in each receptacle. If only a single magnet is used, the intermediate wall is not present.

Lower, vertical and side walls 26, 28, 30, and intermediate walls 32 when present, are preferably dimensioned to accommodate the magnets 24 in the receptacles 22 with minimum clearance such that the magnets 24 firmly and securely fit in the receptacles 22. Also, the lower, vertical and side walls 26, 28, 30, and intermediate walls 32 when present, may be integral with the front wall 14 of the housing 10 as shown.

Bumper 20 extends over the magnets 24 and thereby hinders and ideally prevents dislodgment of the magnets 24 from the receptacles 22. By covering the magnets 24, bumper 20 also cushions the magnets 24 from impacts with objects during use of the vacuum cleaner.

Figure 4:
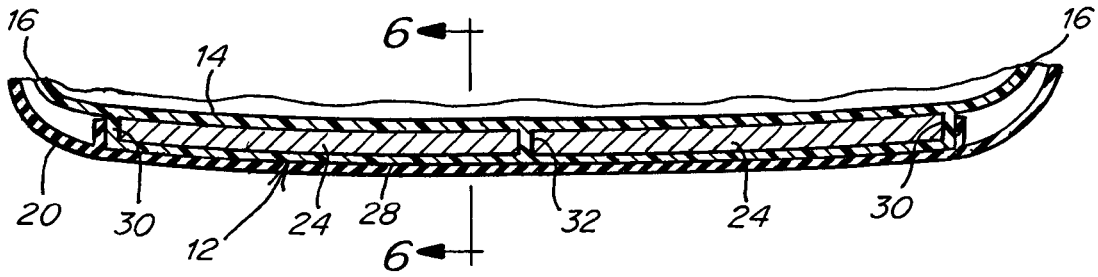
FIG. 4 is a cross-section taken along the line 4-4 of FIG. 1.
Figure 5:
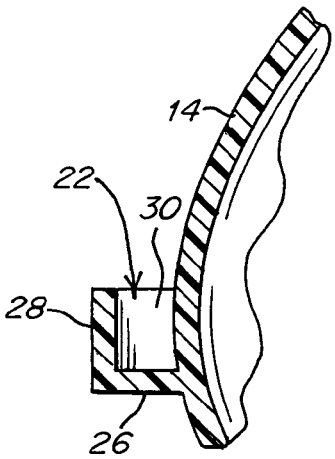
FIG. 5 is a cross-section taken along the line 5-5 of FIG. 3.
Figure 6:
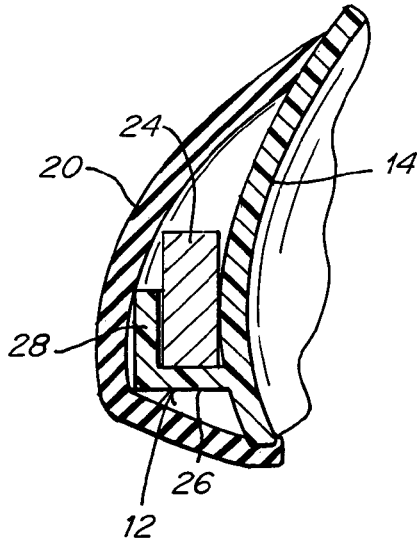
FIG. 6 is a cross-section taken along the line 6-6 of FIG. 4.

As shown in FIG. 4, magnets 24 extend over a significant part of the front wall 14. This facilitates the application of magnetic force to the coverage area of the vacuum opening 18, i.e., the working surface of the vacuum cleaner, during use of the vacuum cleaner so that any metallic objects in the coverage area which might be drawn into the vacuum opening 18 are instead drawn to the magnets 24.

Although magnets 24 are shown as being elongate and being received in elongate receptacles 22, other shapes of magnets 24 and correspondingly-shaped receptacles 22 can be used in accordance with the invention. Also, the magnets 24 can have different sizes and strengths, in the same magnetic pick-up mechanism 12, depending upon the needs of the user and the size/shape of the metal objects that are contained in the floor surface to be cleaned. Any magnets of any composition can be used, such as solid iron-containing magnets.

There are several advantages to forming the pick-up mechanism 12 in connection with the vacuum cleaner housing 10 and/or having a bumper 20 extend over the magnets 24 of the pick-up mechanism 12. For example, in the event that a magnet 24 is lost during use, installation of a new magnet 24 is very easy and does not require any tools. Specifically, the bumper 20 is removed from engagement with the housing 10 by sliding one or both of its ends out from the slots in the side walls 16 of the housing 10 to expose the pick-up mechanism 12, i.e., the receptacles 22 and any remaining magnets 24. Then, a new magnet 24 is placed into the empty receptacle 22 and the bumper 20 is reattached to the housing 10.

In addition, as discussed above, the bumper 20 serves to hinder dislodgment of the magnets 24 from the receptacles 22.

Moreover, the integral formation of the receptacles 22 with the front wall 14 of the housing 10 avoids the need for external fasteners to connect the magnets 24 or a retaining structure therefor to the housing 10.

Although the magnetic pick-up mechanism 12 is described in connection with the front wall 14 of a vacuum cleaner housing 10, since vacuum cleaners are typically used in a forward direction and the front wall 14 will pass over a dirty section of floor covering first, it is possible to place similar magnetic pick-up mechanisms, i.e., receptacles and magnets, on the side walls and/or rear wall of a vacuum cleaner housing. This would be useful, for example, in the event the vacuum cleaner is pulled rearward over a dirty section of floor covering which has not been passed over by the vacuum cleaner when being pushed in a forward direction.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention. For example, while the magnetic pick-up mechanism in accordance with the invention is described in combination with a vacuum cleaner, it is understood that the mechanism can be used in any appliance or device useful for picking up debris and other waste through an opening by action of partial vacuum.

We claim:

1. A vacuum cleaner, comprising:

a housing having a front wall and a vacuum opening situated rearward of said front wall and through which debris and litter are drawn by a vacuum force, said front wall having at least one receptacle extending across said front wall;

at least one magnet arranged in said at least one receptacle, each of said at least one magnet being elongate; and a bumper attached to said housing and extending over said at least one magnet, whereby said at least one magnet attracts metallic objects during use of the vacuum cleaner so that the metallic objects do not enter into said vacuum opening.

2. The vacuum cleaner of claim 1, wherein said at least one receptacle is formed on a forward side of said front wall.

3. The vacuum cleaner of claim 1, wherein said housing has a side wall extending from each edge portion of said front wall, said bumper extending across said front wall and along said side walls and being attached to said housing along said side walls.

4. The vacuum cleaner of claim 1, wherein said housing includes a lower support wall projecting outward and forward from a front surface of said front wall, a substantially vertical retaining wall extending upward from a forward edge region of said lower wall and retaining side walls each arranged at a lateral edge portion of said lower and vertical walls, said at least one receptacle being defined by said front, lower, vertical and side walls.

5. The vacuum cleaner of claim 1, wherein said at least one receptacle is defined by bottom, front, rear and side surfaces and has only an open top to enable insertion and removal of said at least one magnet only through said top of said at least one receptacle.

6. A vacuum cleaner comprising:

a housing having a front wall and a vacuum opening situated rearward of said front wall and through which debris and litter are drawn by a vacuum force, said front wall having at least one receptacle;

at least one magnet arranged in said at least one receptacle; and a bumper attached to said housing and extending over said at least one magnet, said housing including a lower support wall projecting outward and forward from a front surface of said front wall, a substantially vertical retaining wall extending upward from a forward edge region of said lower wall and retaining side walls each arranged at a lateral edge portion of said lower and vertical walls, said at least one receptacle being defined by said lower, vertical and side walls, whereby said at least one magnet attracts metallic objects during use of the vacuum cleaner so that the metallic objects do not enter into said vacuum opening.

7. The vacuum cleaner of claim 6, wherein said at least one receptacle on said front wall of said housing is two receptacles and said at least one magnet is two magnets each arranged in a respective one of said receptacles.

8. The vacuum cleaner of claim 6, wherein said at least one receptacle on said front wall of said housing is three receptacles and said at least one magnet is three magnets each arranged in a respective one of said receptacles.

9. The vacuum cleaner of claim 6, wherein said at least one receptacle is a plurality of receptacles, said housing further including at least one intermediate separation wall interposed between said side walls to partition a space between said lower, vertical and side walls into said plurality of receptacles.

10. The vacuum cleaner of claim 6, wherein said lower, vertical and side walls are integral with said front wall.

11. A vacuum cleaner, comprising:

a housing having a front wall and a vacuum opening situated rearward of said front wall and through which debris and litter are drawn by a vacuum force;

a bumper attached to said housing and extending across said front wall; and a magnetic pick-up mechanism arranged in connection with said front wall and between said front wall and said bumper, said bumper being removable from attachment to said housing while said pick-up mechanism remains in connection with said front wall, said magnetic pick-up mechanism comprising at least one receptacle on said front wall of said housing and at least one magnet arranged in said at least one receptacle, said at least one receptacle extending across said front wall and each of said at least one magnet being elongate, whereby said magnetic pick-up mechanism attracts metallic objects during use of the vacuum cleaner so that the metallic objects do not enter into said vacuum opening.

12. The vacuum cleaner of claim 11, wherein said at least one receptacle is formed on a forward side of said front wall.

13. The vacuum cleaner of claim 11, wherein said pick-up mechanism includes a lower support wall projecting outward and forward from a front surface of said front wall, a substantially vertical retaining wall extending upward from a forward edge region of said lower wall and retaining side walls each arranged at a lateral edge portion of said lower and vertical walls, said at least one receptacle being defined by said front, lower, vertical and side walls.

14. The vacuum cleaner of claim 11, wherein said housing has a side wall extending from each edge portion of said front wall, said bumper extending along said side walls and being attached to said housing along said side walls.

15. A vacuum cleaner, comprising a housing having a front wall and a vacuum opening situated rearward of said front wall and through which debris and litter are drawn by a vacuum force;

a bumper attached to said housing and extending across said front wall; and a magnetic pick-up mechanism arranged in connection with said front wall and between said front wall and said bumper, said bumper being removable from attachment to said housing while said pick-up mechanism remains in connection with said front wall, said magnetic pick-up mechanism comprising at least one receptacle on said front wall of said housing and at least one magnet arranged in said at least one receptacle, said pick-up mechanism including a lower support wall projecting outward and forward from a front surface of said front wall, a substantially vertical retaining wall extending upward from a forward edge region of said lower wall and retaining side walls each arranged at a lateral edge portion of said lower and vertical walls, said at least one receptacle being defined by said lower, vertical and side walls, whereby said magnetic pick-up mechanism attracts metallic objects during use of the vacuum cleaner so that the metallic objects do not enter into said vacuum opening.

16. The vacuum cleaner of claim 15, wherein said at least one receptacle is two receptacles and said at least one magnet is two magnets each arranged in a respective one of said receptacles.

17. The vacuum cleaner of claim 15, wherein said at least one receptacle is three receptacles and said at least one magnet is three magnets each arranged in a respective one of said receptacles.

18. The vacuum cleaner of claim 15, wherein said at least one receptacle is a plurality of receptacles, said housing further including at least one intermediate separation wall interposed between said side walls to partition a space between said lower, vertical and side walls into said plurality of receptacles.

19. The vacuum cleaner of claim 15, wherein said lower, vertical and side walls are integral with said front wall.

20. A method for attracting metallic objects in floor coverings to a housing prior to passage of a vacuum opening in the housing over the floor coverings, comprising:

forming at least one receptacle on a front wall of the housing to extend across the front wall of the housing;

arranging at least one elongate magnet in the at least one receptacle; and attaching a bumper to the housing to cover the at least one magnet such that metallic objects in floor coverings are attracted to the at least one magnet as the housing passes over the metallic objects and are retained on the bumper without passing into the vacuum opening.

21. The method of claim 20, wherein the at least one receptacle is formed on a forward side of the front wall of the housing.

22. A vacuum cleaner, comprising:

a housing having a front wall and a vacuum opening situated rearward of said front wall and through which debris and litter are drawn by a vacuum force, said front wall having at least one receptacle;

at least one magnet arranged in said at least one receptacle, said at least one receptacle being defined by bottom, front, rear and side surfaces and having only an open top to enable insertion and removal of said at least one magnet only through said top of said at least one receptacle; and a bumper attached to said housing and extending over said at least one magnet, whereby said at least one magnet attracts metallic objects during use of the vacuum cleaner so that the metallic objects do not enter into said vacuum opening.

* * * * *